United States Patent [19]

Casey

[11] 3,970,130

[45] July 20, 1976

[54] TICKET HOLDER

[76] Inventor: Everett Randolph Casey, 5845 Old Orchard Trail, Orchard Lake, Mich. 48033

[22] Filed: Sept. 15, 1975

[21] Appl. No.: 613,171

[52] U.S. Cl. ..... 150/39
[51] Int. Cl.[2] ..... A45C 11/18
[58] Field of Search ..... 150/39; 206/39

[56] References Cited

UNITED STATES PATENTS

| | | | |
|---|---|---|---|
| 1,558,921 | 10/1925 | Reichle | 150/39 X |
| 2,828,975 | 4/1958 | Wright | 150/39 X |
| 3,435,868 | 4/1969 | Stermer | 150/39 |

*Primary Examiner*—Donald F. Norton

[57] ABSTRACT

A holder for tickets or the like having a foldable cover portion and a pocket with an open end having three discrete flap portions, with each of the flap portions being of reduced length along a line spaced from the edge of the open end.

6 Claims, 5 Drawing Figures

TICKET HOLDER

BRIEF SUMMARY OF THE INVENTION

This invention is directed to ticket cases and more particularly to an improved arrangement for permitting ready insertion and removal of the ticket while yet providing essentially full protection for the contained ticket.

DETAILED DESCRIPTION

Figure 1:
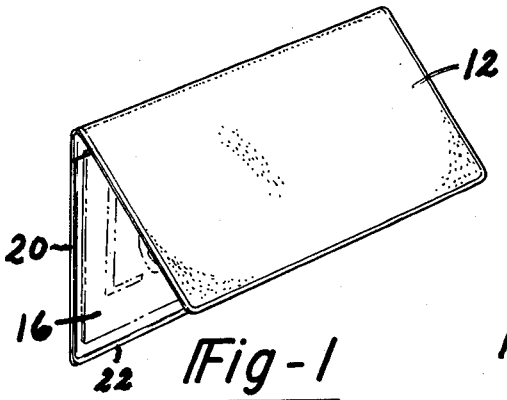
FIG. 1 is a perspective view of a foldable ticket holder, shown partially closed, embodying the principles of the present invention.
Figure 2:
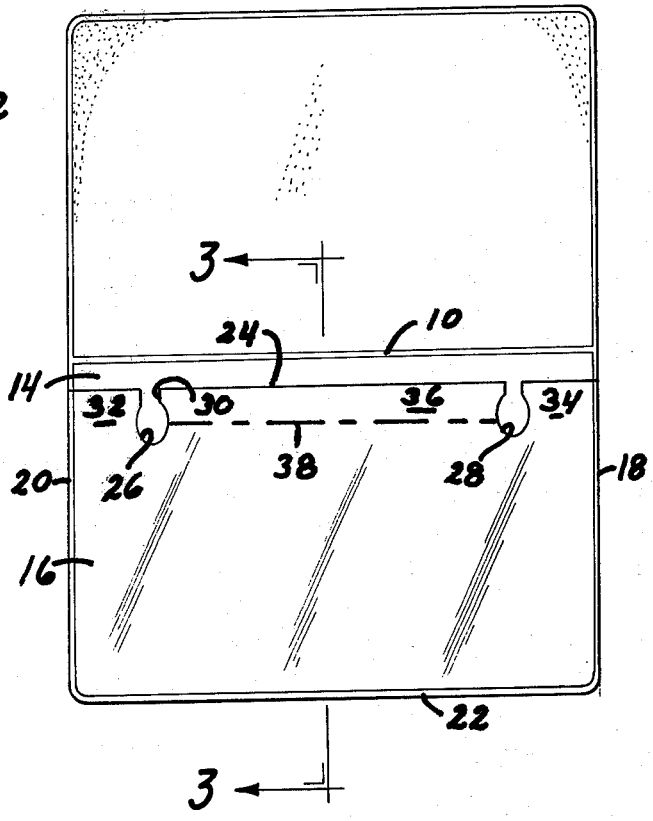
FIG. 2 is an elevational view of the inner surface of the opened foldable ticket holder of FIG. 1.
Figure 3:
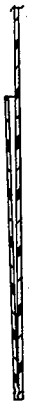
FIG. 3 is a fragmentary sectional view taken substantially along the line 3—3 of FIG. 2.

The ticket holder as disclosed in the drawings comprises a generally rectangular flexible plastic sheet, such as vinyl, having a transverse fold line 10 lying essentially medially of the height of the case to divide the sheet into an upper or front portion 12 and lower or back portion 14. The exterior of the flexible sheet is shown, in part, in FIG. 1 and the inner surface of the sheet is illustrated in FIG. 2. The sheet may be folded about fold line 10 to a fully closed position, the partially closed condition of the holder being illustrated in FIG. 1.

A flat transparent plastic facing element 16 is secured to the inner surface of portion 14 along lateral edges 18 and 20 and along bottom edge 22. Sheet 16, which also may be of vinyl, is desirably thinner, and hence more flexible than the flexible plastic sheet 12-14. In a constructed embodiment, flexible plastic sheet 12-14 was about 0.017 inches thick and the transparent facing element 16 was about 0.009 inches thick.

The integration of the edges 18, 20 and 22 with the flexible plastic sheet 14 may be accomplished, as an example, by heat sealing the two portions together. In the same sense, the heat sealing operation may also be applied to the edge portions of member 14 adjacent edges 18 and 20 and between facing element 16 and the fold line 10, as well as around the periphery of the portion 12. Similarly, the fold line 10 may in fact be formed through the use of a heat sealing tool.

The top edge 24 (FIG. 2) of the facing element 16 is not sealed or adhered to the plastic sheet portion 14 and hence element 16 serves, in conjunction with the adjacent surface of element 14, as a pocket or envelope which is open at the top, that is, along top edge 24. The width of the pocket or envelope between the lateral edges 18 and 20 is preferably greater than the width of the ticket which is to be received, and the height of the pocket or envelope between the bottom edge 22 and the top edge 24 is preferably greater than the height of the ticket which is to be received, the width and height of the ticket being, in some circumstances with larger tickets, the height and width of a ticket as folded for insertion in the carrying case.

Apertures 26 and 28 are formed in the surface of the facing element 16. Aperture 26 comprises an enlarged generally circular portion, proximate to but spaced from the edge 24, connected by a narrowed or neck portion 28 with the edge portion 24. As illustrated, the main portion of aperture 26 is preferably frustoprolate rather than purely circular. Aperture 28 is similar in shape. Apertures 26 and 28 are preferably equidistant from the vertical center line of the case and each is preferably spaced toward the outboard edge, such as edge 20 and 18, respectively. In the preferred embodiment, the vertical center line of aperture 26 is spaced inboard of the edge 20 by an amount approximately 1/7 th of the distance between the edges 18 and 20, and aperture 30 is similarly but reversely located. The portion of top edge 24 adjacent edge 20 and the left hand surface (FIG. 2) of aperture 26 contribute to defining an outboard flap 32, and symmetrically, an outboard flap 34 is defined, in part, by the right hand edge of aperture 28 and the right hand portion of edge 24. Central flap 36 is defined by the central portion of top edge 24, the right hand edge of aperture 26 (including the right hand edge of neck portion 30) and the left hand edge of aperture 28. Thus, the central flap 24 is defined, in part, by a pair of spaced apart side edges directed in a converging sense in a direction towards the bottom edge 22. As a result the central flap 24 is generally trapezoidal, in effect, having a narrowed section or dimension, parallel with top edge 24, generally along the dot-dash line 38 as shown in FIG. 2 of the drawings. Hence, flap 36 tends to have a reduced resistance to bending along the line 38, relative to its resistance to bending along lines thereabove parallel to the top edge 24, as well as relative to the portion thereof below the line 38, within the outline of the apertures 26 and 28.

Figure 5:
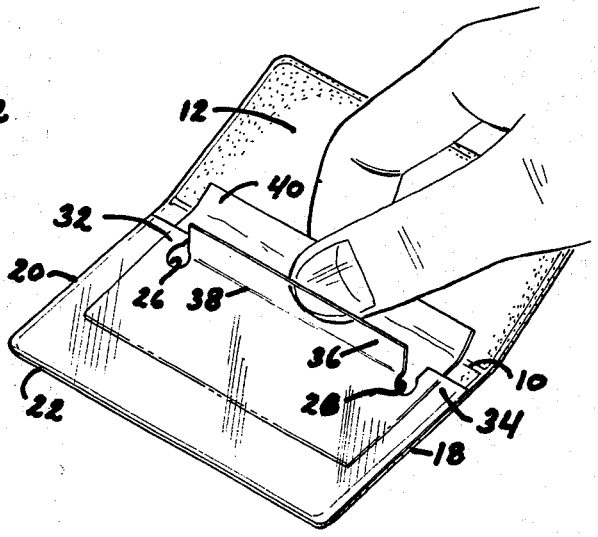
FIG. 5 is a perspective view of the ticket holder of FIG. 1 in a manipulated position to facilitate removal of a ticket.

As a result, if a ticket 40 is disposed within the case, with the top edge of the ticket desirably being disposed in a location between top edge 24 and line 38, its removal may be facilitated by exerting a bending force along the top edge 24 (tending to rotate edge 24 away from element 14, as is illustrated in FIG. 5 of the drawings). The central flap 36, in response to that force, is bendable and tends to bend along that narrower portion illustrated by line 38. By thus bending or deflecting central flap 36 outwardly from the plane of the surface 16, as is illustrated in FIG. 5, the major central portion of the top section of the ticket 40 becomes accessible and may be grasped and readily withdrawn.

Figure 4:
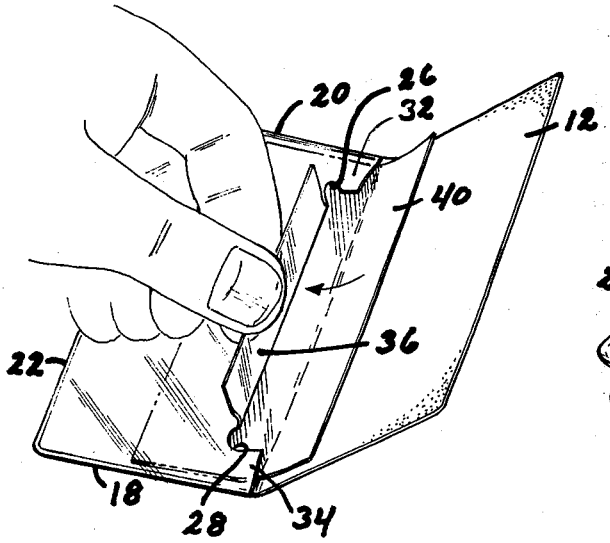
FIG. 4 is a perspective view of the ticket holder of FIG. 1 in a manipulated position to facilitate insertion of a ticket.

To insert a ticket in the case, the same bending force, as above described, may be extended to the point at which it exerts a tensioning force through the element 16 in an area below the apertures 26 and 28 to exert forces to tend to lift the outboard flaps 22 and 34 away from the surface 14, as is illustrated in FIG. 4. This effective tensioning force opens the top of the pocket or envelope between edges 18 and 20 to permit the ticket 40 to be inserted into underlying relationship with outboard flaps 32 and 34 as well as central flap 36, and to be advanced into the fully pocketed position.

What is claimed is:

1. A carrying case for a ticket or the like comprising a flexible plastic sheet having a transverse fold line and foldable about said fold line to define mating front and back cover portions, a flat transparent plastic facing element having lateral, bottom and top edges and having a width between said lateral edges greater than the width of a ticket and a height between said bottom and top edges greater than the height of the ticket, means securing each of said lateral and said bottom edges to an inner portion of said foldable plastic sheet to one side of said transverse fold line to define a pocket open at said top edge to accept the ticket, said flexible facing element having first and second outboard flaps and a central flap, each of said flaps constituting a portion of said facing element adjacent to and including a portion of said top edge of said facing element, each of said outboard flaps extending from the adjacent lateral edge of said facing element to a point inboard thereof lying short of the midpoint of said top edge of said facing element, each of said outboard flaps having a side edge extending generally in the same sense as the lateral edges of said facing element, said central flap being disposed between said outboard flaps, the length of said central flap being established by a pair of spaced-apart side edges directed in a converging sense in a direction toward said bottom edge of said facing element to define a narrower portion of said flap spaced from said top edge, said central flap being bendable and bending along said narrower portion in response to a bending force applied to said central flap along the top edge portion thereof, tension forces lifting said central flap away from said plastic sheet being transmitted through portions of said facing element between said central flap and each of said outboard flaps to deflect portions of each of said outboard flaps away from said plastic sheet.

2. The combination of claim 1 in which said side edges of each of said outboard flaps and the adjacent side edge of said central flap are defined by an individual aperture in said facing element extending from the top edge thereof a distance toward said bottom edge thereof and having an enlarged generally circular portion spaced from said top edge and having a narrowed neck portion adjacent said top edge.

3. The combination of claim 2 in which said enlarged generally circular portion is generally prolate.

4. The combination of claim 2 in which the length of said central flap, along said top edge, is several times greater than the length of either of said outboard flaps, along said top edge thereof.

5. The combination of claim 2 in which tension forces lifting said central flap away from said plastic sheet are further transmitted through portions of said facing element disposed toward said bottom edge from said generally circular portions of each of said individual apertures to transmit forces tending to lift portions of said outboard flaps and portions of said flexible sheet adjacent thereto in a direction away from said flexible plastic sheet.

6. The combination of claim 5 in which said facing element is thinner and more flexible than said plastic sheet.

* * * * *